US007339126B1

(12) United States Patent
Niedermeyer

(10) Patent No.: US 7,339,126 B1
(45) Date of Patent: Mar. 4, 2008

(54) VARIABLE DIFFERENTIAL ADJUSTOR

(75) Inventor: Karl O. Niedermeyer, Wood Dale, IL (US)

(73) Assignee: Trusty Warns, Inc., Wood Dale, IL (US)

( * ) Notice: Subject to any disclaimer, the term of this patent is extended or adjusted under 35 U.S.C. 154(b) by 0 days.

(21) Appl. No.: 11/778,450

(22) Filed: Jul. 16, 2007

Related U.S. Application Data

(63) Continuation-in-part of application No. 11/736,955, filed on Apr. 18, 2007.

(51) Int. Cl.
*H01H 35/24* (2006.01)

(52) U.S. Cl. ..... 200/81 R

(58) Field of Classification Search ..... 200/81 R, 200/81.9 R, 83 S, 83 SA, 83 T, 83 W, 82 R, 200/82 E, 61.86; 73/700, 726, 730, 732, 73/739, 740; 417/12, 38
See application file for complete search history.

(56) References Cited

U.S. PATENT DOCUMENTS 2,501,660 A * 3/1950 Bohle ..... 200/82 R
3,842,224 A * 10/1974 Weis ..... 200/81.9 R
4,212,591 A * 7/1980 Lamontagne et al. ..... 417/38
4,563,179 A * 1/1986 Sakai ..... 604/245
4,565,488 A * 1/1986 Muck ..... 415/58.4
5,152,670 A * 10/1992 Waldecker ..... 417/38
6,812,417 B1 * 11/2004 Lovell ..... 200/61.25
7,084,363 B1 * 8/2006 Niedermeyer ..... 200/81 R

* cited by examiner

*Primary Examiner*—Michael A Friedhofer
(74) *Attorney, Agent, or Firm*—William M. Lee, Jr.; Barnes & Thornburg LLP

(57) ABSTRACT

A variable differential adjustor for a fluid pressure-actuated switch, with the fluid, in the preferred form of the invention, being air. The restrictor has a restrictor housing having a passage through which a pressure source has a portion which passes on its way to a pressure-actuated switch. A restrictor is provided for engaging the portion of the pressure source passing through the restrictor housing and is adjustable to variably alter fluid flow through the pressure source portion. The restrictor comprises a screw-like plug in the pressure source portion which is acted upon by a tube throttle to variably alter the passageway past the plug. A gauge may be provided for determining adjustment of fluid flow.

10 Claims, 4 Drawing Sheets

VARIABLE DIFFERENTIAL ADJUSTOR

RELATED APPLICATION

This application is a continuation-in-part of co-pending U.S. patent application Ser. No. 11/736,955, filed Apr. 18, 2007.

BACKGROUND OF THE INVENTION

This invention relates to fluid control, and in particular to a variable differential adjustor for a fluid pressure-actuated switch, with the fluid, in the preferred form, being air.

In dwellings and other structures using sump pumps to drain subterranean building footings and avoid ingress of water into the structure, it is important that the sump pump be actuated when water removal limits occur. Thus, sump pumps have switches that are activated by many different types of actuation devices, such as floats, pressure pads and pressure tubes. It is the latter type of structure that is utilized with the invention of the present application.

Pressure tubes typically extend into a sump pit or other water collection area, and as water rises in the sump pit, pressure within the tube increases until a pressure-actuated switch is closed, thus activating the sump pump. Once the water level is reduced below a certain level by the sump pump, the pressure-actuated switch is deactivated, and pumping ceases. To control the level at which pumping begins, typically the tube is repositioned up or down, which then translates into a higher or lower water level which commences actuation of the sump pump. If repositioning of the pressure tube is impossible or inconvenient, then the only manner in which to change the actuation of a pressure-actuated switch would be to restrict air pressure to the switch, effectively delaying actuation or deactivation of the switch.

One form of such a delay is disclosed in U.S. Pat. No. 7,084,363, the disclosure of which is incorporated herein by reference. In the device of the '363 patent, a restrictor is provided having a restrictor housing with a fluid passage in which a restrictor plug, typically a set screw, is engaged. By judicious adjustment of the position of the set screw, fluid flow to and from the pressure the pressure-actuated switch is controlled, controlling when the switch is activated to control activation and deactivation of the sump pump.

SUMMARY OF THE INVENTION

The invention relates to a variable differential adjustor for a fluid pressure-actuated switch, comprising a restrictor housing having a passage therethrough. A pressure source has a portion passing through the passage and it is connected to the pressure-actuated switch for directing fluid to and from the pressure-actuated switch. A restrictor is provided for engaging the pressure source portion, with the restrictor being adjustable to variably alter fluid flow through the pressure source portion.

In accordance with the preferred form of the invention, the pressure source portion comprises a flexible tube having an internal bore, and the restrictor includes an element located in the bore and a tube throttle in the restrictor housing external the tube and proximate the element. The element preferably comprises a plug engaged in the bore, the plug having at least one external fluid path. The plug, in the disclosed version of the invention, comprises a screw and the external fluid path comprises a helical thread in the screw. The bore in the tube is smooth and the screw is engaged with the bore with threaded peaks. The path thus comprises a helical fluid pathway between the screw and the bore.

The tube throttle comprises a pair of rigid half cylinders in the passage which sandwich the tube therebetween. A compressor member urges the half cylinders together. Preferably the compressor member comprises an adjustable screw threadedly engaged in the restrictor housing and bearing against one of the half cylinders.

In accordance with another form of the invention, the restrictor housing has a passage, and similar to the first form of the invention, the pressure source has a portion passing through the passage in the restrictor housing and connected to the pressure-actuated switch for directing fluid to and from the pressure-actuated switch. The restrictor engages the pressure source portion and is adjustable to variably alter fluid flow through the pressure source portion. A gauge is located at least partially on the restrictor housing for determining adjustment of fluid flow. Preferably, the gauge comprises a dial face on the restrictor housing and a rotatable dial arm on the restrictor. The dial arm extends from the adjustable screw of the restrictor, and in accordance with the preferred form of the invention, the dial face includes pressure gradation markings.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
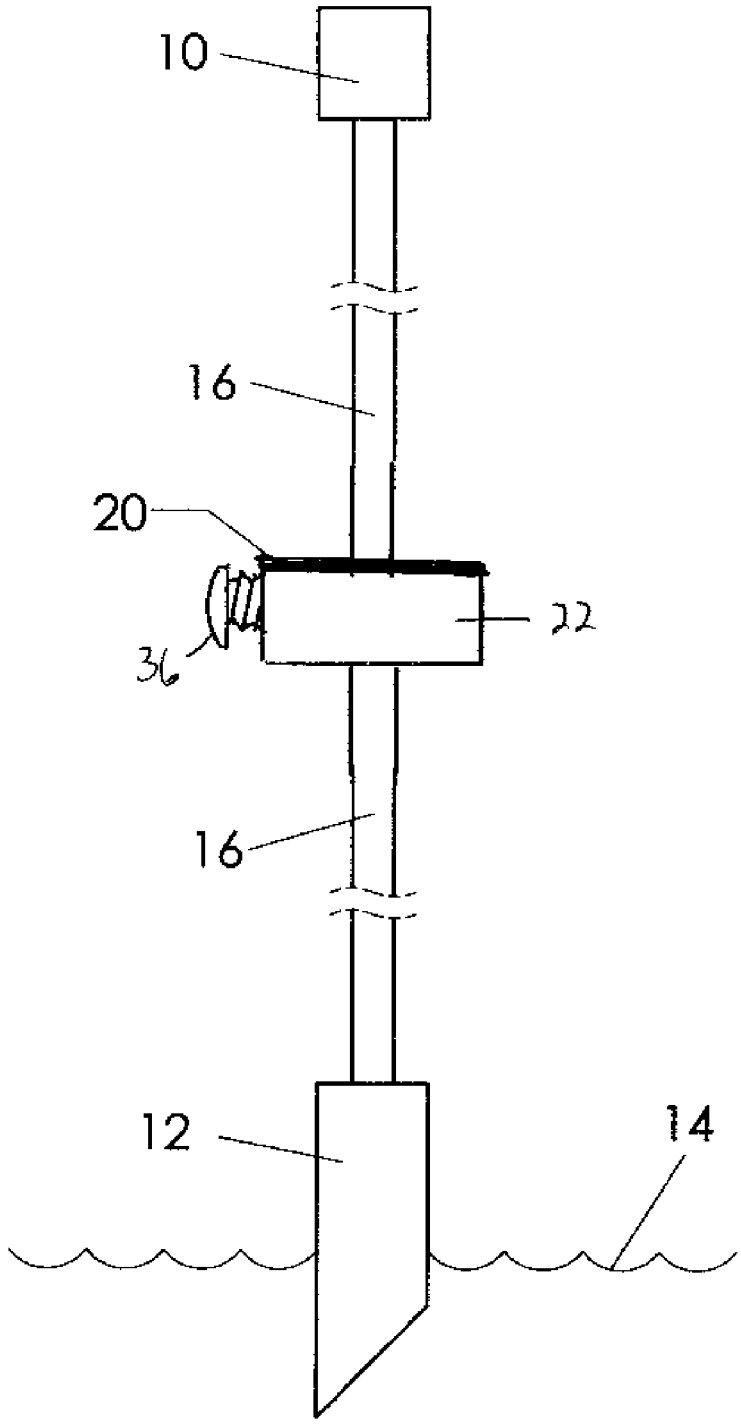
FIG. 1 is an elevational view of a pressure-actuated switch connected to a pressure tube, with the variable differential adjustor of the invention interposed between the pressure tube and the pressure-actuated switch.

FIG. 1 illustrates a typical arrangement for activating a fluid-actuated switch 10, which, in turn, activates a sump pump or similar device (not illustrated). The pressure-actuated switch may be a conventional switch well known to those skilled in the art. Air, in the preferred form of the invention, is the fluid that is used for switch actuation.

A pressure tube 12 extends to the sump pit or other water collection area, and as the level of the water 14 rises or falls, air pressure within the pressure tube 12 changes commensurately. That pressure is communicated to the pressure-actuated switch by means of hollow tubing 16.

To control transmission of fluid pressure from the pressure tube 12 to the switch 10, a variable differential adjustor 20 according to the invention is installed on the tubing 16. As best illustrated in FIGS. 2 and 3, the variable differential adjustor 20 comprises two basic elements, a restrictor housing 22 and a restrictor, described in greater detail below, which is adjustable to variably alter fluid flow through the restrictor housing.

The tubing 16 includes a pressure source portion which comprises a tube 24, having an internal bore 26, which passes through the restrictor housing 22. The restrictor includes an element in the form of a plug 28 engaged in the bore, the plug 28 having at least one external fluid path between the plug and the bore 26. The plug 28 preferably comprises a screw with its external fluid path comprising a helical thread 30 in the screw. The screw forming the plug 28 can be conventional, and has thread peaks engaging the bore 26, leaving a helical fluid passage between the screw and the bore 26. The helical fluid passage thus becomes a restricted passage to control pressure transmission through the variable differential adjustor 20.

Figure 2:
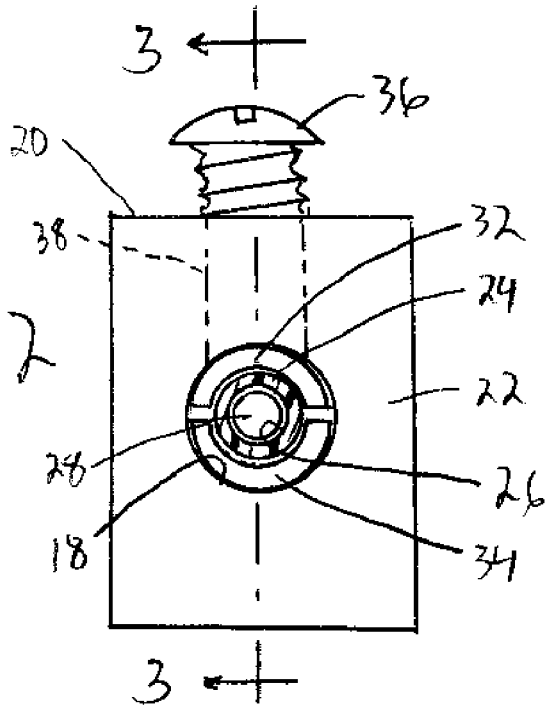
FIG. 2 is an enlarged view of the variable differential adjustor, in cross section through the hollow tubing used.
Figure 3:
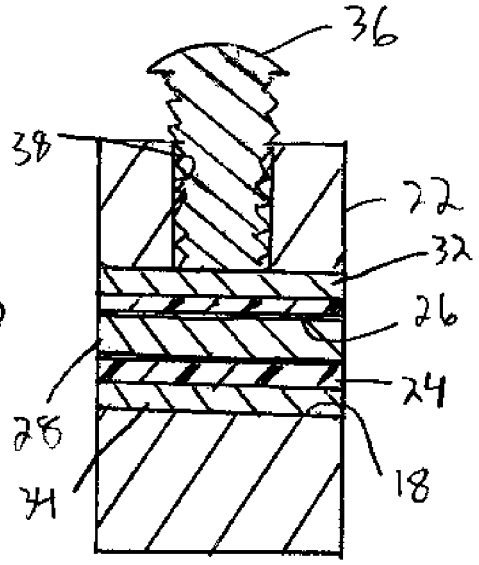
FIG. 3 is a cross sectional view taken along lines 3-3 of FIG. 2, showing the elements of the variable differential adjustor.
Figure 4:
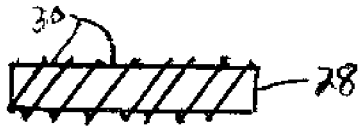
FIG. 4 is an elevational illustration of the plug forming the restrictor element.
Figure 5:
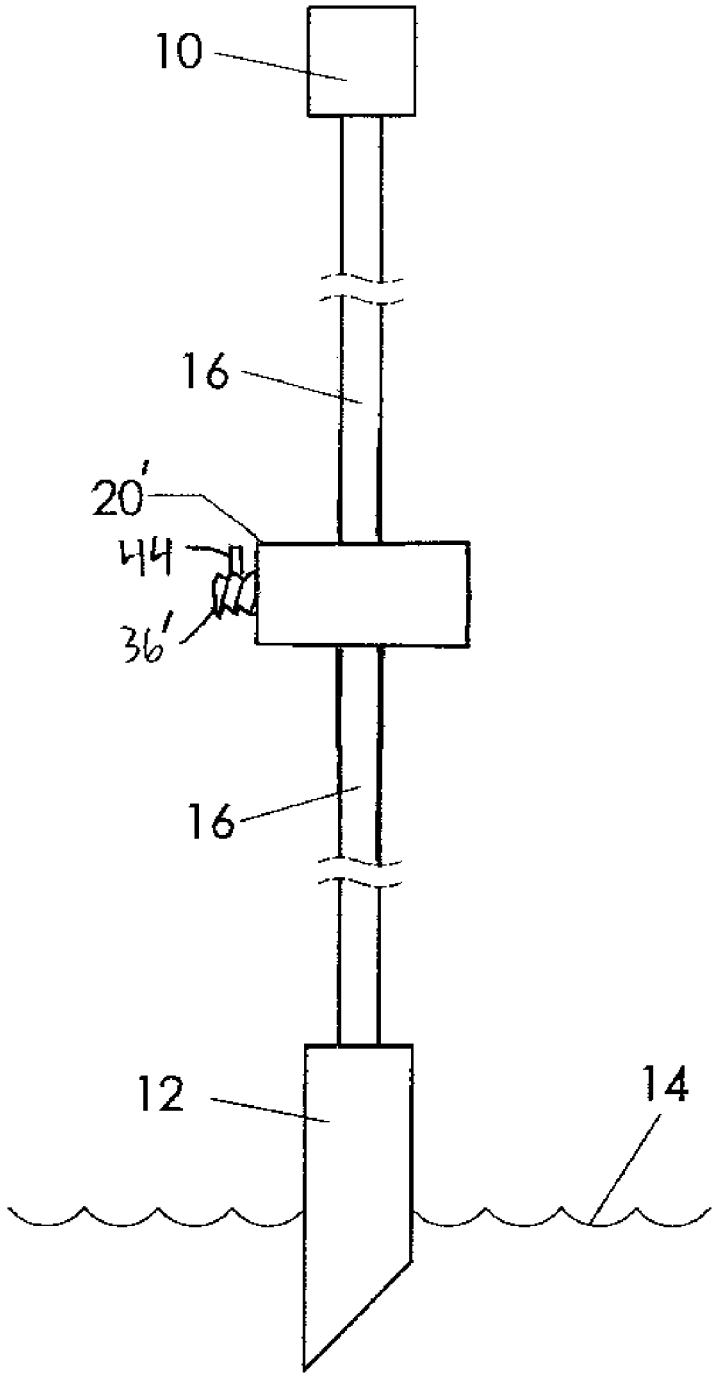
FIG. 5 is an elevational view of a second form of a pressure-actuated switch according to the invention.
Figure 6:
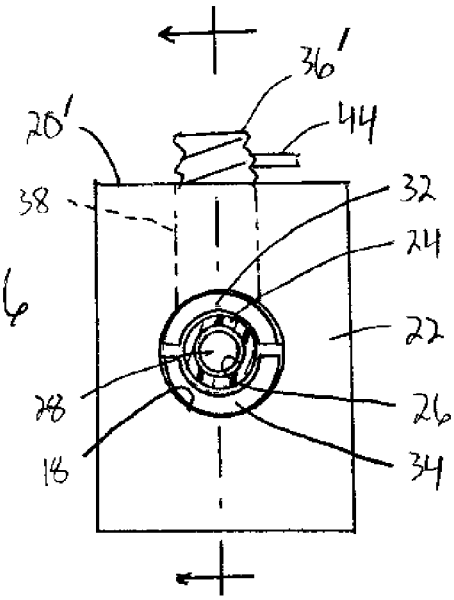
FIG. 6 is an enlarged view of this form of the invention, in cross-section through the hollow tubing used.
Figure 7:
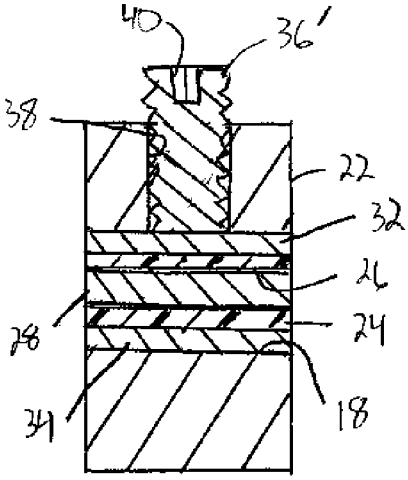
FIG. 7 is a cross-sectional view taken along lines 6-6 of FIG. 6, showing the elements of the variable differential adjustor of this form of the invention.
Figure 8:
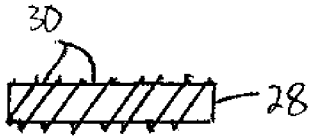
FIG. 8 is an elevational view of the restrictor plug.

The restrictor further comprises a tube throttle external the tube 24 and proximate the plug 28, as illustrated in FIGS. 2 and 3. The tube throttle includes a pair of rigid, half cylinders 32 and 34 in the passage 18, which sandwich the tube 24 therebetween. A compressor member, in the form of an adjustable screw 36, urges the half cylinders 32 and 34 together. The adjustable screw 36 is threadedly engaged in a bore 38 in the restrictor housing 22, and bears against the half cylinder 32.

The tube 24 is preferably made of a soft material, such as rubber or plastic, while the half cylinders 32 and 34 are preferably made of metal. Thus, by judicious adjustment of the screw 36, the tube 24 is squeezed between the half cylinders 32 and 34. This, when squeezing force is applied, forces the flexible material of the tube 24 into the threads 30, effectively decreasing the size of the passageway for fluid through the variable differential adjustor 20. That, then, increases the amount of time until effective pressure is experienced at the switch 10 to activate the switch. Conversely, when the screw 36 is adjusted to release the squeezing pressure, exactly the opposite occurs. Thus, by the adjustment of the screw 36, the build-up or reduction of pressure in the upper portion of the tubing 16 to the pressure actuated switch 10 is controlled. That, then, can change the level of the water 14 at which the pressure-actuated switch 10 is activated and also the level at which the pressure-actuated switch is deactivated. To use the example in incorporated U.S. Pat. No. 7,084,363, if a four-inch difference in the water level 14 would normally be the on and off positions of the switch 10 without utilization of the variable differential adjustor 20, with installation of the variable differential adjustor 20, that can be changed dramatically, depending on how much force is exerted by the adjustable screw 36 to the half cylinders 32 and 34. The greater the force, the slower the pressure builds in the upper portion of the tubing 16 (and, conversely, diminishes as the water level drops), thus quite variably changing the effective on and off water levels in a sump pit or other water collection area being monitored.

It will be evident that the invention can take different forms and function in the same manner. As an example, although the plug 28 is shown and described as an element having helical threads 30, the plug can be provided with one or more longitudinal grooves rather than helical grooves. Also, although a pair of half cylinders 32 and 34 has been illustrated, other similar squeezing elements can be employed, so long as the tube 24 can be manipulated to increase or decrease the effective size of the fluid passageway through the variable differential adjustor 20.

A second form of the invention is illustrated in FIGS. 5 through 9, with a variable differential adjustor 20'. All elements of the invention remaining the same as the first form of the invention bear the same reference characters, as described above. They will not be redescribed now.

Just as in the first form of the invention, the variable differential adjustor 20' is installed on the tubing 16. The restrictor housing 22, the tubing 16 and the restrictor comprising the plug 28 and tube throttle having the rigid, half cylinders 32 and 34 remain the same. In this form of the invention, however, the adjustable screw 36 is replaced by an adjustable screw 36' having a hex opening 40 engageable by an Allen wrench or the like.

Figure 9:
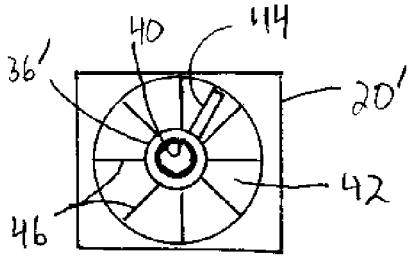
FIG. 9 is a top plan view of the gauge of this form of the invention.

A gauge is provided in this form of the invention for determining adjustment of fluid flow. As best illustrated in FIG. 9, the gauge comprises a dial face 42 on the restrictor housing 20' and a dial arm 44 extending from the screw 36' and rotatable therewith. As shown, the 42 surrounds the screw 36', and include a series of pressure gradation markings 46, which may or may not be identified by numbers, letters or the like for representing applied pressure. As the screw 36' is turned, the dial arm 46 traverses the dial face 42, and the user can determine the relative throttling by the tube throttle based upon the location of the dial arm 44 on the dial face 42.

While the invention has been described for use in relation to monitoring water level in a sump pit, the invention can be used for monitoring levels of liquids in practically endless applications. Various changes can be made to the invention without departing from the spirit thereof or scope of the following claims.

What is claimed is:

1. A variable differential adjustor for a fluid pressure-actuated switch, comprising:

a. a restrictor housing having a passage therethrough, b. a pressure source having a portion passing through said passage and connected to said pressure-actuated switch for directing fluid to and from said pressure-actuated switch, c. a restrictor for engaging said pressure source portion, said restrictor being adjustable to variably alter fluid flow through said pressure source portion, and d. a gauge located at least partially on said restrictor housing for determining adjustment of the fluid flow.

2. The variable differential adjustor according to claim 1, in which said gauge comprises a dial face on said restrictor, housing and a notable dial arm on said restrictor.

3. The variable differential adjustor according to claim 2, in which the restrictor includes an adjustable screw threadedly engaged in said restrictor housing, and surrounded by said dial face, said dial arm extending from said adjustable screw.

4. The variable differential adjustor according to claim 2, in which said dial face includes pressure gradation markings.

5. The variable differential adjustor according to claim 1, in which said pressure source portion comprises a flexible tube having an internal bore, and said restrictor includes an element located in said bore and a tube throttle in said restrictor housing external said tube and proximate said element.

6. The variable differential adjustor according to claim 5, in which said element comprises a plug engaged in said bore, said plug having at least one external fluid path.

7. The variable differential adjustor according to claim 6, in which said plug comprises a screw and said external fluid path comprises a helical thread in said screw.

8. The variable differential adjustor according to claim 7, in which said bore is smooth and said screw is engaged with said bore with threaded peaks, said path comprising a helical fluid pathway between said screw and said bore.

9. The variable differential adjustor according to claim 5, in which said tube throttle includes a pair of rigid half cylinders in said passage and sandwiching said tube therebetween, and a compressor member urging said half cylinders together.

10. The variable differential adjustor according to claim 9, in which said compressor member comprises an adjustable screw threaded engaged in said restrictor housing and bearing against one of said half cylinders.

* * * * *